United States Patent [19]

Uchinami et al.

[11] Patent Number: 4,915,082

[45] Date of Patent: Apr. 10, 1990

[54] AIR-FUEL RATIO CONTROLLER OF INTERNAL COMBUSTION ENGINE

[75] Inventors: Masanobu Uchinami; Toshihisa Takahashi; Kenji Ogawa, all of Himeji; Hitoshi Inoue, Amagasaki; Shinichi Nishida, Himeji, all of Japan

[73] Assignee: Mitsubishi Denki Kabushiki Kaisha, Tokyo, Japan

[21] Appl. No.: 318,881

[22] Filed: Mar. 6, 1989

[30] Foreign Application Priority Data

Mar. 8, 1988 [JP] Japan ..... 63-55245

[51] Int. Cl.[4] ..... F02D 41/14

[52] U.S. Cl. ..... 123/489; 123/440; 204/425

[58] Field of Search ..... 123/440, 489; 204/424, 204/425, 426

[56] References Cited

U.S. PATENT DOCUMENTS

| | | | |
|---|---|---|---|
| 4,548,179 | 10/1985 | Ninomiya et al. | 123/489 X |
| 4,655,182 | 4/1987 | Nakano et al. | 123/489 X |
| 4,715,343 | 12/1987 | Kinoshita | 123/489 |
| 4,721,084 | 1/1988 | Kawanabe et al. | 123/489 X |
| 4,753,204 | 6/1988 | Kojima et al. | 123/440 |
| 4,765,298 | 8/1988 | Kojima et al. | 123/440 |

FOREIGN PATENT DOCUMENTS

| | | |
|---|---|---|
| 129563 | 6/1986 | Japan . |
| 241654 | 10/1986 | Japan . |
| 18659 | 2/1987 | Japan . |

*Primary Examiner*—Tony M. Argenbright

*Attorney, Agent, or Firm*—Sughrue, Mion, Zinn, Macpeak & Seas

[57] ABSTRACT

An air-fuel ratio controller of an internal combustion engine stops current flow of an oxygen pump and power supply to an heater when the engine stops.

In one embodiment the A/F ratio controller related to the invention stops power supply to the heater a predetermined period of time after the engine stops.

7 Claims, 3 Drawing Sheets

AIR-FUEL RATIO CONTROLLER OF INTERNAL COMBUSTION ENGINE

BACKGROUND OF THE INVENTION

1. Field of the Invention

The present invention relates to a device for controlling air-fuel (A/F) ratio of an internal combustion engine and, more particularly, to an air-fuel ratio controller which stops an oxygen pump current and a power supply to a heater when the engine stops.

2. Description of the Prior Art

According to the art proposed by Japanese Utility Model Application Laid-Open No. 62-18659 (1987), using a wide-range air-fuel ratio sensor composed of an oxygen sensor for generating electromotive force according to the difference of oxygen concentration between the atmosphere and exhaust gas from an internal combustion engine and an oxygen pump for allowing pump current to flow in order to take oxygen into and out of exhaust gas for comparison with the atmosphere, the pump current is controlled in order that voltage outputted from the oxygen sensor can be a predetermined value. The proposed air-fuel ratio sensor detects the air-fuel ratio of the engine according to the magnitude of pump current. The air-fuel ratio sensor proposed by the art can continuously measure the air-fuel ratio from rich to lean degree. Conventionally, any A/F ratio controller detects air-fuel ratio by means of pump current by allowing pump current to flow in order that the voltage outputted from the oxygen sensor can be the predetermined value as mentioned above. However, when the engine stops, since an excessive quality of oxygen exists, greater a quantity of pump current must be generated. If the wide-range A/F ratio sensor is operated in presence of the above condition, stabilized zirconia used for composing the oxygen pump or the elements of electrodes used for extracting pump current will degrade themselves to eventually shorten the service life of the wide-range A/F ratio sensor.

In order to activate both the oxygen sensor and the oxygen pump, these must be heated to a high temperature. To achieve this, a heater is provided. Nevertheless, since the heater has substantial current capacity, if the key switch remains ON while the engine stops, its battery will continuously discharge voltage to shorten its own service life.

SUMMARY OF THE INVENTION

The invention has been achieved to fully solve those problems mentioned above.

The primary object of the invention is to provide a novel device for precisely controlling air-fuel ratio of an internal combustion engine, which securely extends service life of the wide-range A/F ratio sensor including the heater.

The second object of the invention is to provide a novel device for precisely controlling the air-fuel ratio of an internal combustion engine, which stops the flow of oxygen pump current while the engine stops so that elements used for composing the oxygen pump can be prevented from degrading themselves.

The third object of the invention is to provide a novel device for precisely controlling the air-fuel ratio of an internal combustion engine, which stops power supply to the heater while the engine stops so that the battery can be prevented from wastefully discharging voltage.

The above and further objects and features of the invention will more fully be apparent from the following detailed description with accompanying drawings.

DESCRIPTION OF THE PREFERRED EMBODIMENTS

Figure 1:
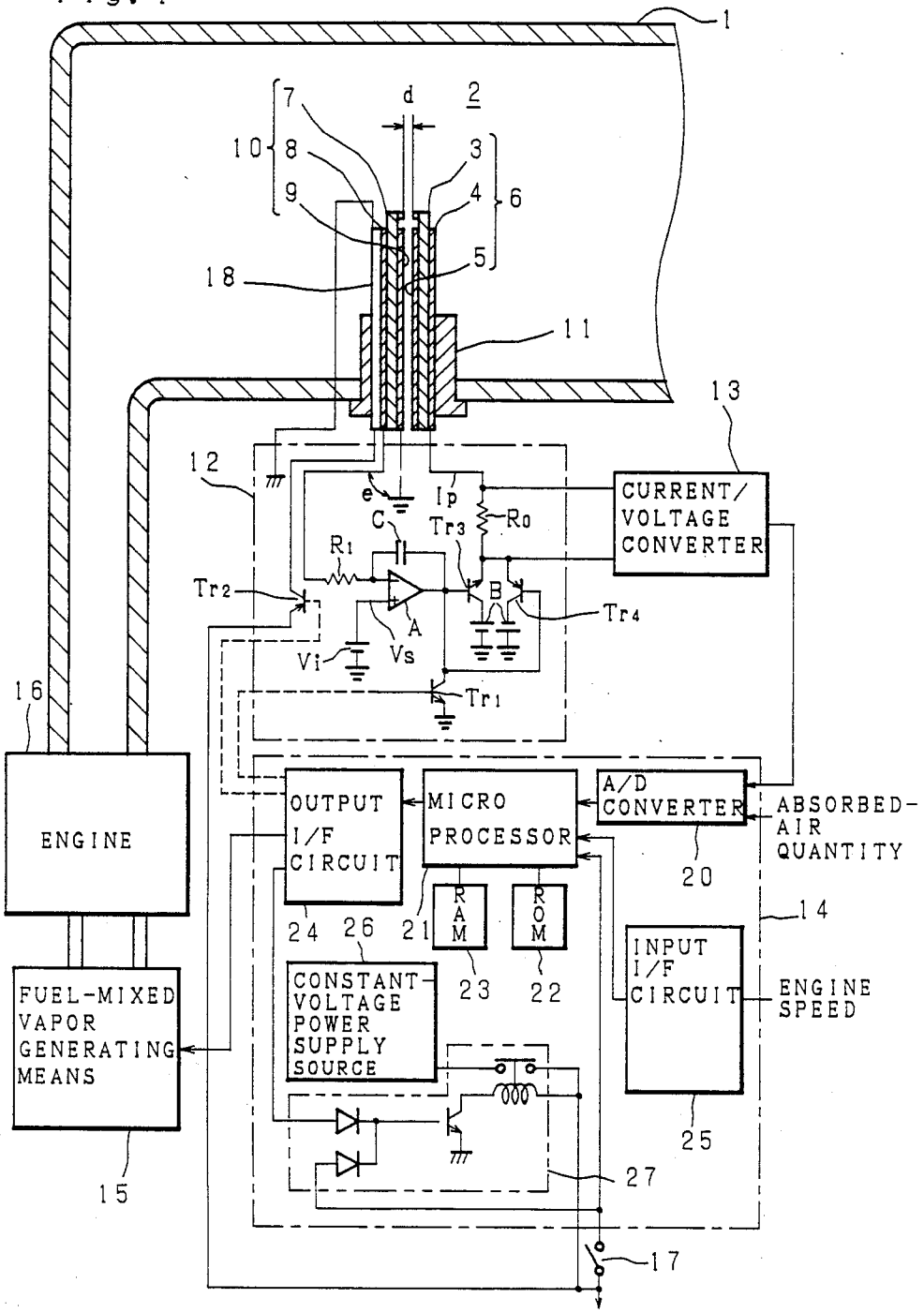
FIG. 1 is the schematic block diagram of the A/F ratio controller related to the invention.

Referring now more particularly to the accompanying drawings, a preferred embodiment of the A/F ratio controller related to the invention is described below. In FIG. 1. the reference numeral 1 designates the exhaust tube of the engine. Wide-range A/F ratio sensor 2 is installed through the wall of the exhaust tube 1. The constitution of the wide-range A/F ratio sensor 2 is described below. Platinum electrodes 4 and 5 are formed on both surfaces of the plane-sheet-like ion conductive solid electrolyte 3 having about 0.5 mm thickness composed of stabilized zirconia so that the oxygen pump 6 can be composed. Platinum electrodes 8 and 9 are formed on both surfaces of the plane-sheet-like ion-conductive solid electrolyte 7 so that the oxygen sensor 10 can be composed.

Supporting bases 11, 11 are disposed opposite from each other across about 0.1 mm of minimal clearance "d" which is provided between the oxygen pump 6 and the oxygen sensor 10. Heater 18 heats both the oxygen pump 6 and the oxygen sensor 10 so that these can be activated for operation.

Next, the constitution of the electronic controller 12 is described below. Collector of transistor $Tr_2$ is connected to heater 18 to feed current to this heater 18 or stop the flow of current to it. Output terminal of electrode 8 of the oxygen sensor 10 is connected to the inverted input terminal of operation amplifier A via resistor $R_1$. The middle of the wire connecting resistor $R_1$ to the inverted input terminal of operation amplifier A is connected to the output terminal of operation amplifier A via capacitor $C_t$. Power-supply source Vi is connected to the non-inverted input terminal of operation amplifier A to supply the objective voltage Vs for generating electromotive force "e" between electrodes 8 and 9 of the oxygen sensor 10. An end of capacitor C is connected to collector of transistor $Tr_1$ to feed current to the oxygen pump 6 or stop the flow of current to it. Output terminal of operation amplifier A is connected to the bases of transistors $Tr_3$ and $Tr_4$. Collectors of transistors $Tr_3$ and $Tr_4$ are respectively connected to DC-power supply source B, whereas emitters of transistor $Tr_3$ and $Tr_4$ are respectively connected to electrode 4 of the oxygen pump 6 via resistor $R_0$.

Next, the functional operation of the electronic controller 12 for controlling air-fuel ratio is described below. Responsive to the difference of the oxygen concentration between atmosphere and exhaust gas of the engine, oxygen sensor 10 feeds electromotive force "e" generated between electrodes 8 and 9 to the inverted input terminal of operation amplifier via resistor $R_1$. Transistors $Tr_3$ and $Tr_4$ are respectively driven by output from operation amplifier A, where the output is proportional to the difference between the reference voltage Vs delivered to the non-inverted input terminal of operation amplifier A and the electromotive force "e", and then, the electronic controller 12 controls pump current Ip flowing between electrodes 4 and 5 of the oxygen pump 6 in order that the electromotive force "e" can be held at the predetermined reference voltage Vs.

Pump current Ip is outputted from DC power supply source B through resistor $R_0$ as the signal corresponding to pump current Ip. Current/voltage converter 13 converts pump current Ip into a specific voltage level. The A/F ratio detection device is composed of the wide-range A/F ratio sensor 2, electronic controller 12, and current/voltage converter 13 mentioned above. In FIG. 1, the reference numeral 16 designates the engine and 17 the key switch which is closed while driving the vehicle.

Next, the constitution of the controller 14 is described below. On receipt of the A/F ratio signal from the current/voltage converter 13, the controller 14 controls fuel-mixed vapor generating means 15. The controller 14 receives data related to the number of the rotation of the engine from the input interface circuit 25. It also receives data related to the absorbed air from analog/-digital (A/D) converter 20. Microprocessor 21 executes computation and logic operation according to the procedure of various programs preliminarily stored in ROM 22. RAM 23 provisionally stores values computed by the microprocessor 21. The reference numeral 24 designates output interface circuit, 26 constant-voltage power-supply source, and 27 power-supply source control circuit which controls ON/OFF operation of the constant-voltage power-supply source 26. When the key switch 17 is turned ON, the power-supply source control circuit 27 always turns itself ON to activate operation of the controller 14. While the key switch 17 is OFF, according to the instruction of the microprocessor 21, the constant-voltage power-supply source 26 is turned OFF.

When the engine is driven without causing the wide-range A/F ratio sensor 2 to execute feedback control, A/D converter 20 converts analog value of the data of adsorbed air quantity into a digital value. The microprocessor 21 reads the preliminarily programmed procedure and constant from ROM 22, and then computes the optimal quantity of fuel to be supplied. The result of the computation is delivered to fuel-mixed vapor generating means 15 via the output interface circuit 24. In accordance with the pulse width used for driving the electromagnetic fuel injection valve inside of fuel-mixed vapor generating means 15 for example, the microprocessor 21 controls the A/F ratio of the mixed vapor generated by fuel-mixed vapor generating means 15.

When driving the engine by applying feedback control in response to the signal from the A/F ratio sensor 2, i.e., in accordance with the pump current Ip, unlike the open-loop control mentioned above, correction by means of the pump current Ip is added, where the correction by PI control generally includes an adequate amount of ripple component.

Figure 2:
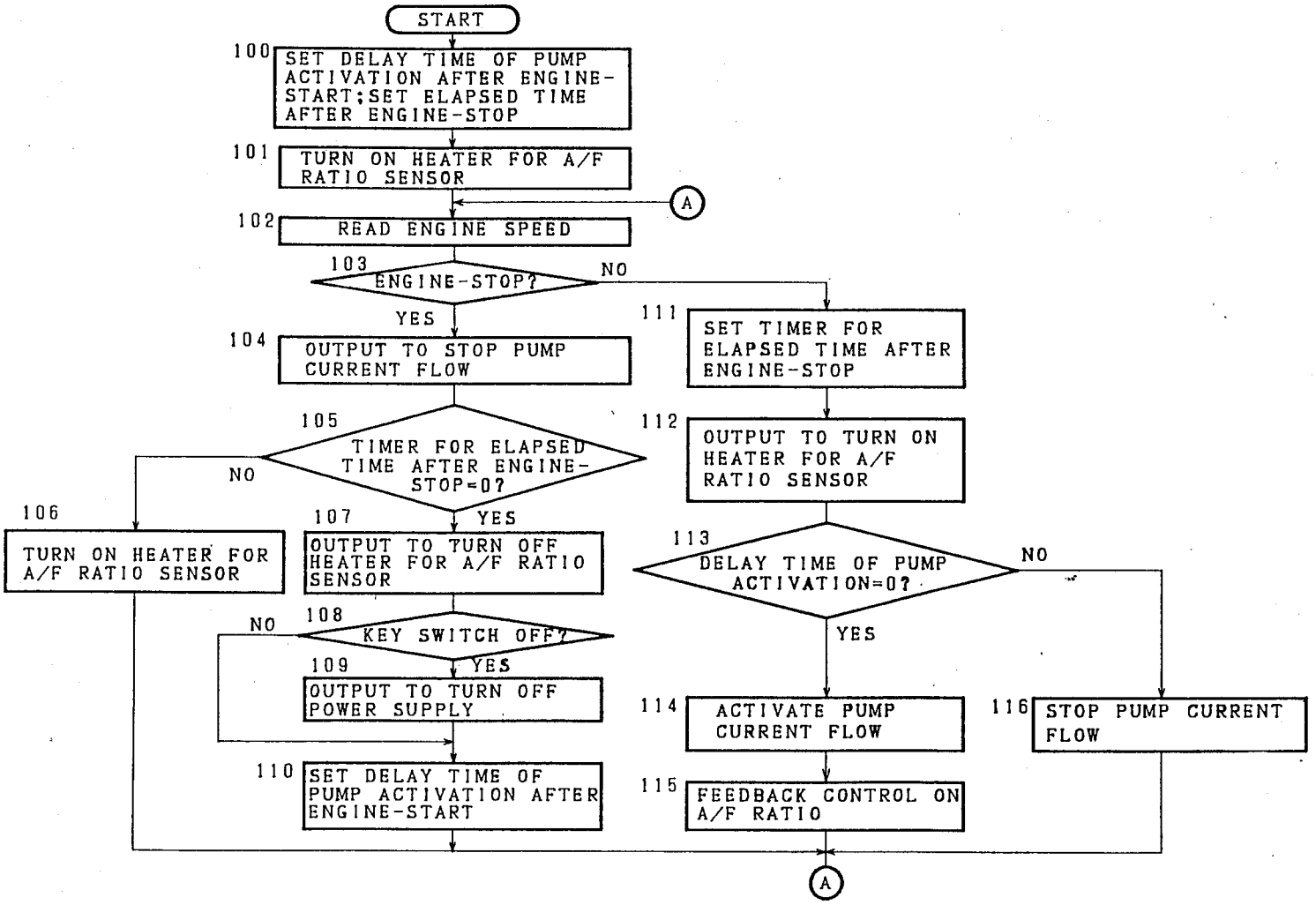
FIGS. 2 and 3 are respectively the flowcharts explaining sequential operations of the A/F ratio controller related to the invention, which are executed while the engine stops.

Next, referring now to flowcharts shown in FIGS. 2 and 3, sequential operations of the controller 41 is described below. Programs needed for executing operations of these flowcharts are stored in ROM 22. After turning ON the key switch 17, simultaneously with the connection of the constant-voltage power supply source 26, execution of the program begins. First, in step 100, the controller 14 sets the delay time until the heater 18 can radiate high temperature and the time passed after activation of the engine and also the elapsing time after the stop of the engine. The controller 14 then turns transistor $Tr_2$ ON. As a result, heater 18 is turned ON while step 101 is underway. Next, in step 102, the controller 14 reads the number of the rotation of the engine. Next, in step 103, the controller 14 judges whether the engine stops, or not. If the engine stops, the controller 14 stops the flow of pump current Ip through transistor $Tr_1$ while step 104 is underway. In step 105, the controller 14 judges whether or not a predetermined period of time has already passed after the step of the engine. If the predetermined period of time has not yet past, heater 18 remains ON and the operation mode is back to step 102. If the predetermined period of time has already past, operation mode proceeds to step 107, in which the heater 18 is turned OFF via transistor $Tr_2$. Next, in step 108, the controller 14 judges whether or not the key switch 17 is OFF. If the key switch 17 is ON, operation mode proceeds to stop 110. If the key switch 17 remains OFF, operation mode proceeds to step 109, in which the power supply source 26 is turned OFF so that the controller 14 terminates the control operation at the moment when the microprocessor 26 can no longer operate itself with the lowered power voltage.

If the key switch 17 still remains ON despite the stop of the engine, operation mode proceeds to step 110, in which the engine is activated, and then the controller 14 sets the operational delay time of pump current Ip. This is because of the needs for setting a specific period of time until the reactivated heater 18 can generate high temperature. If the engine is already activated while step 103 is underway, the controller 14 sets timer during step 111 for counting elapsed time after the engine stops. In step 112, heater 18 is turned ON. However, if step 106 is already through, the heater 18 has been already ON. Next, in step 113, the controller 14 judges whether or not the predetermined operational delay time of pump current Ip has already elapsed after activating the engine. Concretely, the controller 14 judges whether or not the heater 18 can already generate high temperature. If the predetermined operational delay time has already past, operation mode proceeds to step 114 to activate pump current Ip, and then, in step 115, the controller 14 starts the feedback control of A/F ratio. If the predetermined operative delay time has not yet past, operation mode proceeds to step 116 to stop the flow of pump current Ip.

Next, the functional operation of the controller 14 is described below under the condition in which the key switch 17 remains OFF after stopping the engine. Operation mode of the heater 18 and the pump current Ip proceeds to step 103 from the activated condition. First, the controller 14 stops the flow of pump current Ip while step 104 is underway. Immediately after the stop of the engine, the heater 18 remains ON for a while. Since the heater 18 still contains high temperature for a while and the pump-current operational delay time is zero, when the engine is reactivated, the controller 14 instantly starts the A/F ratio feedback control operation. If the engine is stopped, while step 107 is processed, the controller 14 stops operation of the heater 18 after elapsing the predetermined period of time. If the key switch 17 remains OFF, while step 109 is processed, the controller 14 turns its own power supply source OFF before terminating the A/F ratio feedback control operation.

On the other hand, if the key switch 17 still remains ON, while step 110 is underway, the controller 14 stops the flow of pump current Ip, and then, operation mode returns to step 102 until the heater 18 generates high temperature.

Figure 3:
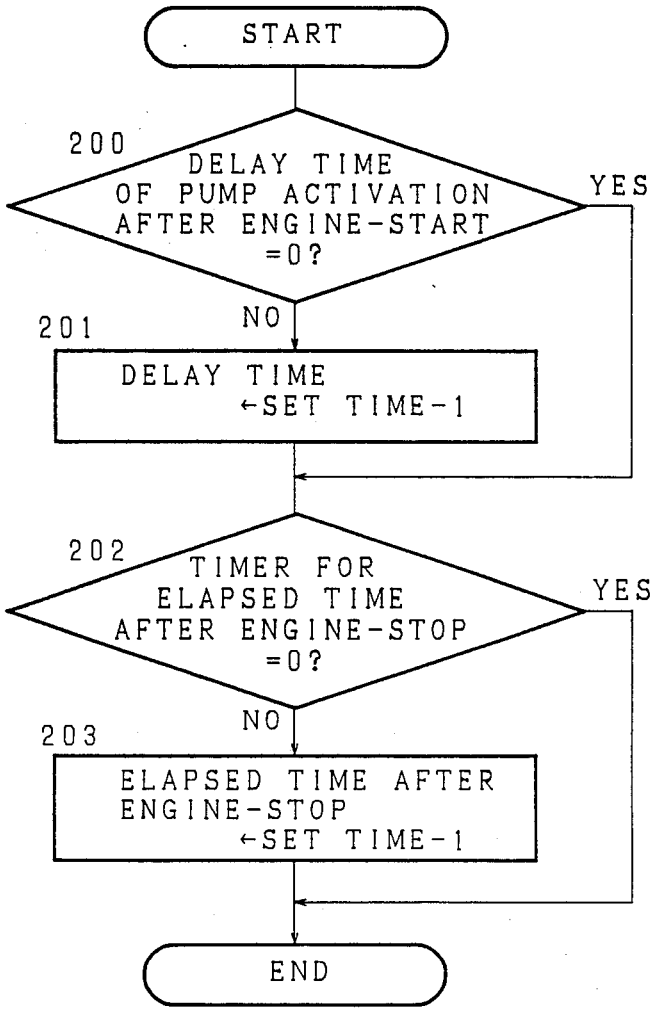

As shown in FIG. 3, after activating the engine, the controller 14 executes interruption in connection with the pump current operational delay time and the elapsed time after stopping the engine every 10 milliseconds for example which makes up the basic unit time. The controller 14 subtracts the value of timer every basic unit time and judges whether or not the set time has already passed by checking whether or not the result is zero. Concretely, while step 200 is underway, the controller judges whether or not the pump-current operational delay time is zero. In step 201, the controller subtracts value 1 from the set value and repeats subtractions until the set value becomes zero. The controller 14 processes the elapsed time after the stop of engine in the same way as mentioned above.

The above preferred embodiment causes the flow of pump current to stop simultaneously with the stop of the engine, whereas the heater 18 stops its operation after the predetermined period of time is past.

The A/F ratio controller related to the invention can instantly execute feedback control of air-fuel ratio without awaiting the heating time (about 40 seconds for example) of the heater 18 when the engine is reactivated in a short period of time like 20 seconds for example after stopping its operation temporarily. As a result, the A/F ratio controller related to the invention can securely save fuel cost and improve overall characteristic of exhaust gas as well.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An air-fuel (A/F) ratio controller of an internal combustion engine comprising:

a wide-range A/F ratio sensor having a clearance for introducing engine exhaust gas inside, an oxygen sensor for generating a specific electromotive force in response to the relationship between the oxygen partial pressure inside and outside of said clearance, an oxygen pump for controlling the oxygen partial pressure inside of the clearance by allowing a pump current to flow such that an electromotive force generated by said oxygen sensor is maintained at a predetermined value, and a heater for heating said oxygen sensor and said oxygen pump;

a controller for executing feedback control of the A/F ratio of a fuel-mixed vapor to be supplied to said engine in accordance with the pump current so that the A/F ratio can be at an objective value;

engine-stop detection means for detecting engine speed and for detecting when the engine stops from the detected engine speed;

pump-current stopping means for stopping the flow of the pump current when the engine stops as indicated by said engine-stop detection means; and heater stopping means for stopping power supply to said heater when the engine stops as indicated by said engine-stop detection means.

2. The air-fuel ratio controller of an internal combustion engine as set forth in claim 1, wherein said controller stops power supply to said heater a predetermined time after said engine has stopped.

3. The air-fuel ratio controller of an internal combustion engine as set forth in claim 1, wherein said heater stopping means and said pump-current stopping means are operable when the engine key switch is ON and the engine has stopped.

4. An air-fuel (A/F) ratio controller of an internal combustion engine comprising;

a wide-range A/F ration sensor having a clearance for introducing engine exhaust gas inside of said internal combustion engine, an oxygen sensor for generating a specific electromotive force in response to the relationship between the oxygen partial pressure inside and outside of said clearance, an oxygen pump for controlling the oxygen partial pressure inside of said clearance by allowing pump current to flow so that said electromotive force generated by said oxygen sensor is maintained at a predetermined value, and a heater for heating said oxygen sensor and said oxygen pump;

a controller for executing feedback control of a quantity of fuel-mixed vapor to be supplied to said engine in accordance with said pump current so that the A/F ratio can be at an objective value;

engine-stop detection means for detecting engine speed, and for detecting when the engine stops from the detected engine speed; and pump-control stopping means for stopping said pump current when said engine stops as indicated by said engine-stop means.

5. The air-fuel ratio controller of an internal combustion engine as set forth in claim 4, wherein said pump-current stopping means is operable when the engine key switch is ON and the engine has stopped.

6. An air-fuel (A/F) ratio controller of an internal combustion engine comprisimg;

a wide-range A/F ratio sensor having a clearance for introducing engine exhaust gas inside of said internal combustion engine, an oxygen sensor for generating a specific electromotive force in response to the relationship between the oxygen partial pressure inside and outside of said clearance, an oxygen pump for controlling the oxygen partial pressure inside of said clearance by allowing pump current to flow so that the electromotive force generated by said oxygen sensor can be maintained at a predetermined value, and a heater for heating said oxygen sensor and said oxygen pump;

a controller for executing feedback control of a quantity of fuel to be supplied to said engine in accordance with said pump current so that the A/F ratio can be at an objective value;

engine-stop detection means for detecting the engine speed and for detecting when the engine stops according to the detected engine speed; and heater stopping means for stopping power supply to said heater when said engine stops as indicated by said engine-stop detection means.

7. The air-fuel ratio controller of an internal combustion engine as set forth in claim 6, wherein said heater stopping means is operable when the engine key switch is ON and the engine has stopped.

* * * * *